United States Patent [19]

Martin et al.

[11] 4,370,842

[45] Feb. 1, 1983

[54] REPAIR PATCHING KIT FOR PANELS

[75] Inventors: Verble C. Martin; Robert J. Forestal, both of Indianapolis, Ind.

[73] Assignees: Vern R. Young, Indianapolis; Peter G. Fruehman, Noblesville, both of Ind. ; a part interest to each

[21] Appl. No.: 186,856

[22] Filed: Sep. 15, 1980

[51] Int. Cl.[3] ..... E04G 23/02

[52] U.S. Cl. ..... 52/514

[58] Field of Search ..... 52/27, 514

[56] References Cited

U.S. PATENT DOCUMENTS

| | | | |
|---|---|---|---|
| 1,966,167 | 7/1934 | Denk | 52/27 |
| 2,598,194 | 5/1952 | Shippey | 52/514 |
| 2,997,416 | 8/1961 | Helton | 52/514 |
| 3,999,347 | 12/1976 | Devlin | 52/514 |
| 4,100,712 | 8/1978 | Hyman | 52/514 |
| 4,285,183 | 8/1981 | Condit | 52/514 |
| 4,297,823 | 11/1981 | Keisler | 52/514 |

*Primary Examiner*—James L. Ridgill, Jr.
*Attorney, Agent, or Firm*—Robert A. Spray

[57] ABSTRACT

A kit for convenient repair patching of a panel whose access thereto is from only one side, such as in the situation of a drywall panel of a usual wall or ceiling. In various embodiments, a body member is provided with adequate support, by installation procedures wholly from the one accessible side of the panel, the body member itself providing a large area of the repair surface and/or providing a supportive body substantially bridging across the area of the hole to be repaired, and to which patching mastic may then be applied.

3 Claims, 26 Drawing Figures

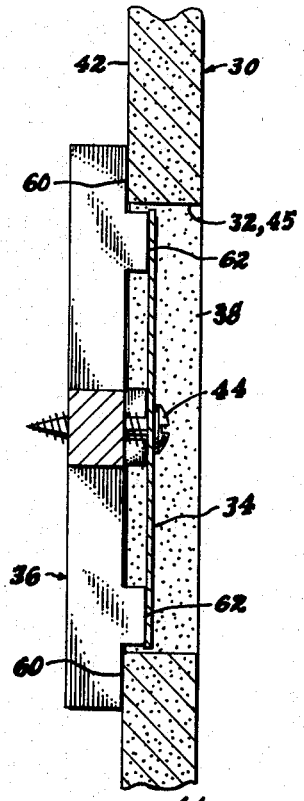
FIG. 11
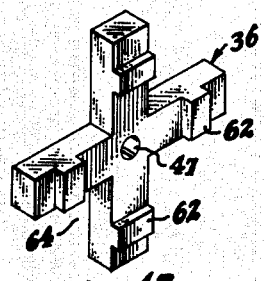
FIG. 13
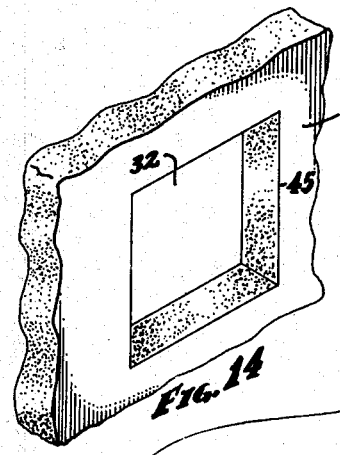
FIG. 14
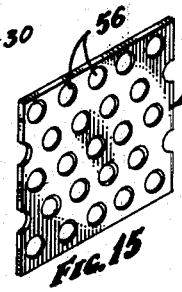
FIG. 15
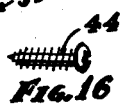
FIG. 16
FIG. 12

REPAIR PATCHING KIT FOR PANELS

The present invention relates to a patching kit for panels.

More particular, the present invention in a variety of embodiments provides a novel, convenient, and economical means for easy repair of a panel, such as a drywall wall or ceiling of a home, to which access may be conveniently had from only one side thereof; and the repair installation by any of these embodiments is so convenient as to be an easily-accomplished "do-it-yourself" project by anyone have only the barest minimum of mechanical talent or aptitude, yet provides also an advantageous and economical repair kit for commercial jobs with experienced repairmen.

More particularly, the present inventive concepts provide a convenient, reliable, and substantially foolproof means for achieving the main goal of a patching repair task using a patching mastic, that is, the easy achievement and provision of a stable body member which effectively bridges across most of the area of the panel hole to be repaired, so that a minimum of patching mastic may be easily applied, and without an undue amount being wasted by falling wastefully into the panel hole, and often with only so little patching mastic being needed that only a single-step procedure need be used rather than requiring a finish coat of mastic after the bulk of an earlier coat has dried with its usual shrinking or other deformation appearing.

In carrying out the invention, the repair kit is provided in various embodiments; but basically it provides first and second body members, with holding means for both of them depending upon the embodiment being considered. A first holding means holds the second (inner) body member up onto or against the inside surface of the panel being repaired, in the region of but straddling the panel hole to be repaired. Second holding means holds the first (outer) body member also in the region of the hole to be repaired but outwardly of the second body member.

Depending upon the embodiment, the first (outer) body member's outer surface is flush with or somewhat inwardly of the panel's outer surface, providing either or both of the repair surface or a hole-bridging body to which patching mastic will adhere without falling wastefully into the hollow wall interior.

The second body member is of operatively long and of discontinuous or slender form, in relation to the size of the panel hole; and this provides that in an installation step the second body member may be conveniently passed through the panel hole from exteriorly of the panel to a position interiorly of the panel, but nevertheless is long enough to straddle the panel hole to provide its function of subsequently providing retaining support for the first body member.

Other concepts of various embodiments provide more particular features, such as the provision that the two holding means are the same screw-type or toggle bolt component, adhesive means is provided in lieu of or in addition to positive fasteners, perforations in the outer body member to provide a dual purpose of better acceptance of the patching mastic and to co-operate with a lug means on the inner body member to restrict inadvertent rotation or mal-positioning of the parts, seating of the outer body member optionally against either a portion of the panel to be repaired or against the inner body member, pre-forming of the outer body member's periphery to assure better and/or more endurable retention of the patching mastic, and means providing convenient support of the repair components during drying or curative time of whatever adhesive is being used.

All embodiments are convenient and economical; and the designation of any one as preferred over the others will depend upon factors such as the relation of expense of components, to ease of use, ease of writing confidence-building instructions for use, packaging considerations, etc., rather than any one embodiment being overwhelmingly desirable over others.

The above is of introductory and somewhat generalized nature, to set forth generally the type of repairs being here achieved, and the basic components or factors of the repair but according to various embodiments of the invention; and more particular details, features, concepts, and advantages are set forth in detail in the accompanying more-detailed description of several embodiments illustrative of the invention concepts, taken with the accompanying drawings.

In the drawings, which are somewhat schematic for disclosure purposes as to the concepts involved, FIGS. 1 through 10 generally are sequential views illustrating the panel-repair and the kit components and concepts of a first embodiment. More particularly, FIG. 1 is a pictorial view of a wall panel prior to any damage;

FIG. 11 is a vertical cross-sectional view, similar to FIG. 8, but on a larger scale and illustrating a second embodiment;

FIG. 12 is an exploded assembly view of the components detailed in FIGS. 13 through 16, and showing as assembled in FIG. 11;

FIG. 13 is a pictorial view of the second or inner body member of the embodiment shown in FIG. 11;

FIG. 14 is a pictorial view of the wall portion whose hole to be repaired has been trimmed or shaped;

FIG. 15 is a pictorial view of the first or outer body member;

FIG. 16 is a view of the connecting screw of the FIG. 11 embodiment;

Figure 22:
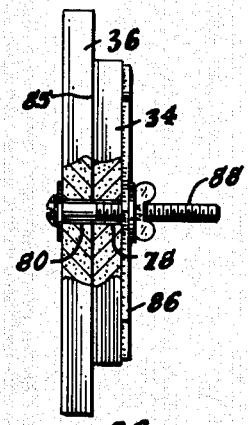
FIG. 22 is an elevational view of the components of a fifth embodiment, portions shown as broken away for clarity, in assembled form as they may appear when purchased as a repair kit, and when in the intermediate repair-stage shown in FIG. 24.
Figure 23:
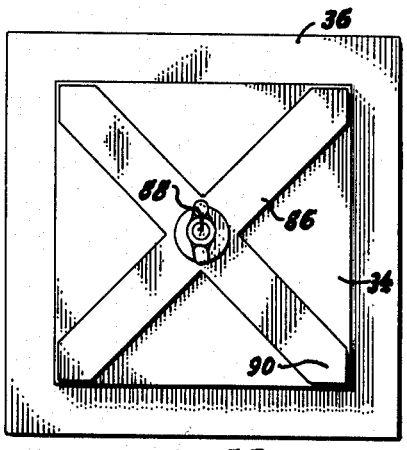
FIG. 23 is an outer elevation view of the parts shown in FIG. 22.
Figure 24:
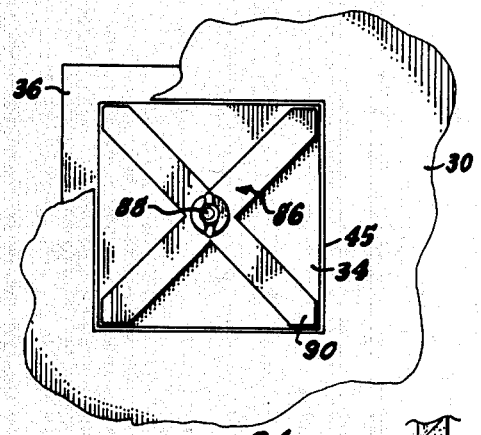
Figure 25:
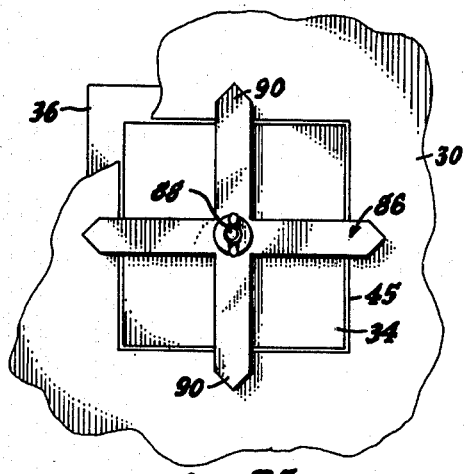
Figure 26:
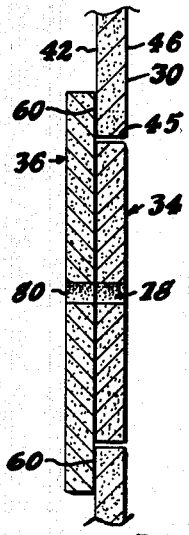

FIGS. 24 and 25 are in smaller scale than FIGS. 22, 23 and 26, although of the same (fifth) embodiment. More particularly, FIG. 24 is an elevation view as seen outwardly of the panel to be repaired; and this view shows the parts of the fifth (FIGS. 22, 23) embodiment in the intermediate repair step in which the parts of FIG. 22 have been already not only inserted inwardly through the panel hole but having already also been pulled back outwardly and oriented so that the first (outer) body member is properly rotated or oriented with respect to the panel hole;

FIG. 25 is an exterior view of the panel, similar to FIG. 24, except that a supplemental or third body member of this embodiment has been now rotated to exteriorly straddle over the panel hole to give support to the repair kit assembly from the outer surface of the panel being repaired; and FIG. 26 is a vertical cross-sectional view through the panel in the site of the hole being repaired, in the same scale as FIGS. 22 and 23, and illustrating the repair as fully completed except for application of some patching mastic peripherally around the edge of the hole.

As shown in the drawings, the present inventive concepts provide a new and advantageous repair patching kit for use in applying a repair patch to a panel 30 such as a drywall wall or ceiling having a hole 32 therein and which typically has no reasonable (or only restricted) access to the interior face to the panel.

Various embodiments are set forth, but all have certain basic concepts which are similar in those embodiments.

More particularly, the basic components include a first or outer body member 34 and a second body member 36; and it is by these body members 34 and 36 that the repair kit provides either a portion of the repaired panel surface or an effective bridge over the panel hole 32 to accept patching mastic 38 as further detailed herein.

As shown, there is provided first holding means 40 for operatively holding the second body member 36 operatively against the interior face 42 of the panel 30 in the region of but straddling the hole 32 in the panel 30; and there is also provided second holding means 44 for operatively holding the first body member 34 in the region of the hole 32 in the panel 30 but exteriorly of the second body member 36 and operatively flush with or inwardly of the exterior face 46 of the panel 30. The hole in the second body member 36 which is engaged by the screw 40,44 is shown at 47.

It will be noted in this embodiment of FIGS. 1 through 10 that the first holding means 40 and the second holding means 44 are here shown as the same component, and that it is shown as being an interconnecting screw member 40,44 which operatively extends between the first body member 34 and the second body member 36. The screw 40,44 maintains the assembled position of the first body member 34 by tensile stress existing in the screw 40,44 when in its interconnecting position, by pulling inwardly on the outer body member 34, as supported by the inner body member 36.

Desirably as shown (FIGS. 3, 4, 5, 7, and 8), the panel hole 30 is enlarged to a regular shape 45 which is similarly-shaped and just slightly larger than the outer portions of the first or outer body member 34, and the exterior face 46 of the panel 30 is also provided with a recess 48 outwardly adjacent the panel hole 32,45; and the first body member 34 has outer portions or tabs 50 which seat onto the exteriorly-facing face 52 of the panel recess 48.

Figure 1:
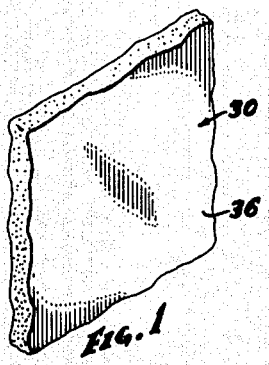
Figure 2:
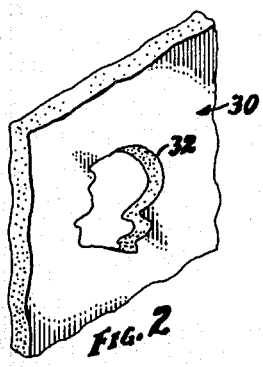
FIG. 2 is a view thereof illustrating a damaging hole having been caused, and needing repairing.
Figure 3:
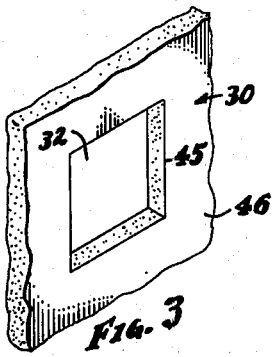
FIG. 3 is a similar view but showing the hole having been trimmed or shaped by a first step of preparing the hole for use of a repair kit according to the inventive concepts.
Figure 4:
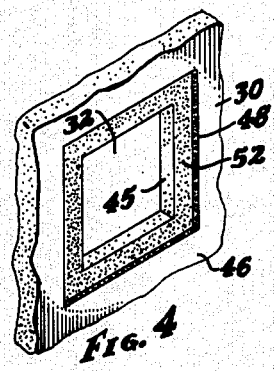
FIG. 4 illustrates the panel and its hole after the hole has been further trimmed in a subsequent step, for use of the repair kit of the first embodiment.
Figure 5:
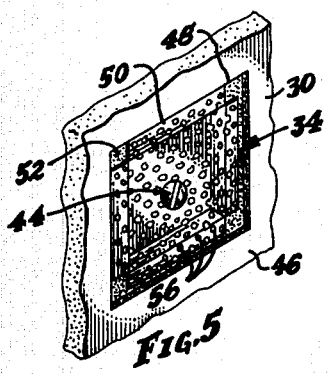
FIG. 5 is a view thereof showing a first body member of the repair kit now in assembled position.
Figure 6:
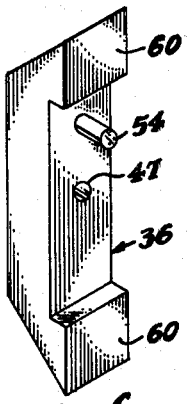
FIG. 6 is an enlarged pictorial view of the inner body member.
Figure 7:
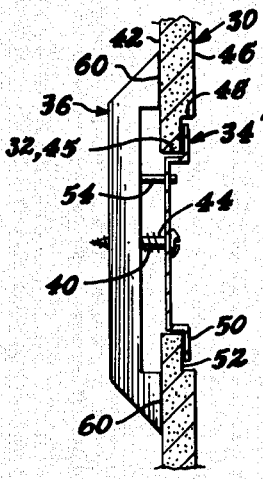
FIG. 7 is a vertical cross-sectional view through the panel, illustrating the two body members in assembled relationship to one another and to the panel at the site of the hole.
Figure 8:
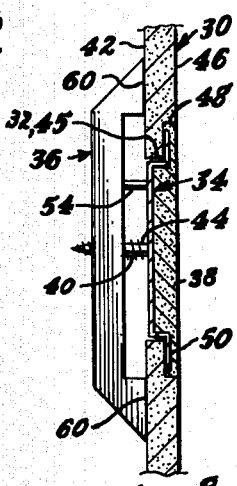
FIG. 8 is a similar view through the panel, illustrating the two body members in assembled relationship to one another and to the panel at the site of the hole, but with patching mastic having been applied onto the first or outer body member.
Figure 9:
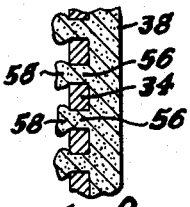
FIG. 9 is an enlarged detail view illustrating the protrusion of the patching mastic through holes in the first or outer body member.
Figure 10:
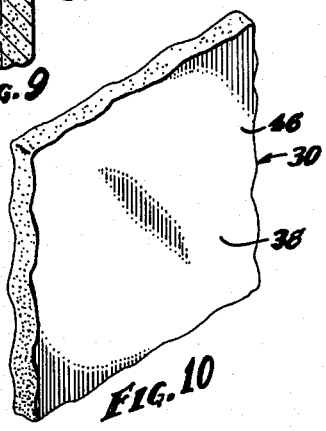
FIG. 10 is a view similar to FIG. 1 but illustrating the wall as now repaired or patched.

As best illustrated in FIGS. 5 and 9, the first body member 34 of this embodiment is desirably a perforated plate member. Further, it will be noted that the second body member 36 is shown as provided with an exteriorly-directed lug 54. The perforations 56 in the plate member 34 serve to permit the emergence therethrough of necks 58 of the patching mastic 38 for better retention of the same; and the plate holes 56 also provide an opening in the first body member 34 through which the lug 54 may extend for assisting in the maintaining of a certain orientation of the first body member or plate 34 with respect to the panel hole 32,45.

Adhesive means may be provided also, as at 60, to co-act between the outer portions of the second or inner body member 36 and the interior face 42 of the panel 30 outwardly adjacent the panel hole 32,45.

In the second embodiment, as shown in FIGS. 11 through 16, such adhesive means 60 are used in this manner, and provide the only support for the second or inner body member 36. In contrast to the situation in the first embodiment, in the second embodiment it will be noted that the position of the first body member 34, when it and the second body member 36 are in their installed positions, is established by portions of the first body member 34 operatively seating against leg portions 62 of the second body member 36, those leg portions 62 extending into and being in the hollow core of the panel hole 32,45.

As in the first embodiment, the second embodiment also uses a screw 44, but the screw 44 holds only the first or outer body plate 34 to the second or inner body member 36.

The parts and concepts of the second embodiment are illustrated in exploded view in FIG. 12.

In the various embodiments, it will be noted that the second or inner body member 36 is of operatively long and of discontinuous or slender form, in relation to the size of the panel hole 32,45, which provides that in an installation step the second body member 36 may be passed inwardly through the panel hole 32,45 from exteriorly of the panel 30 to a position interiorly of the panel 30, but nevertheless the inner body member 36 is long enough to straddle over or across the panel hole 32,45 to provide its function of providing retaining support for the first body member 34.

Figure 17:
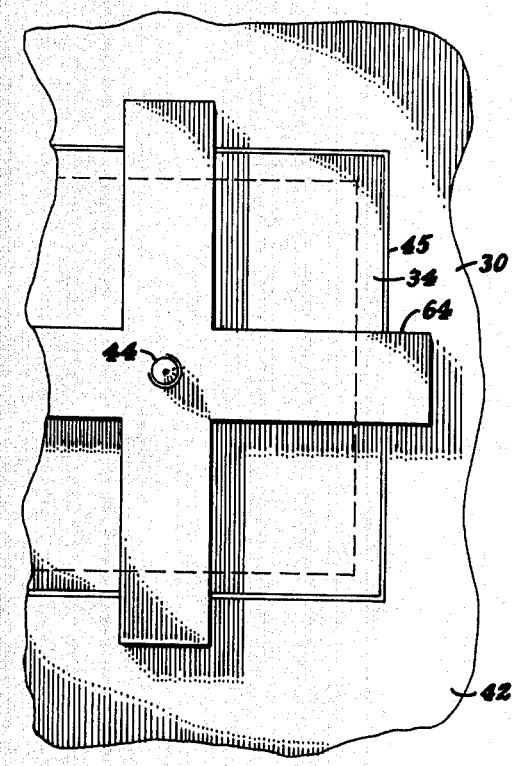
FIG. 17 is an elevational view, as seen from inside the wall, of a third embodiment such as shown in FIG. 18.
Figure 20:
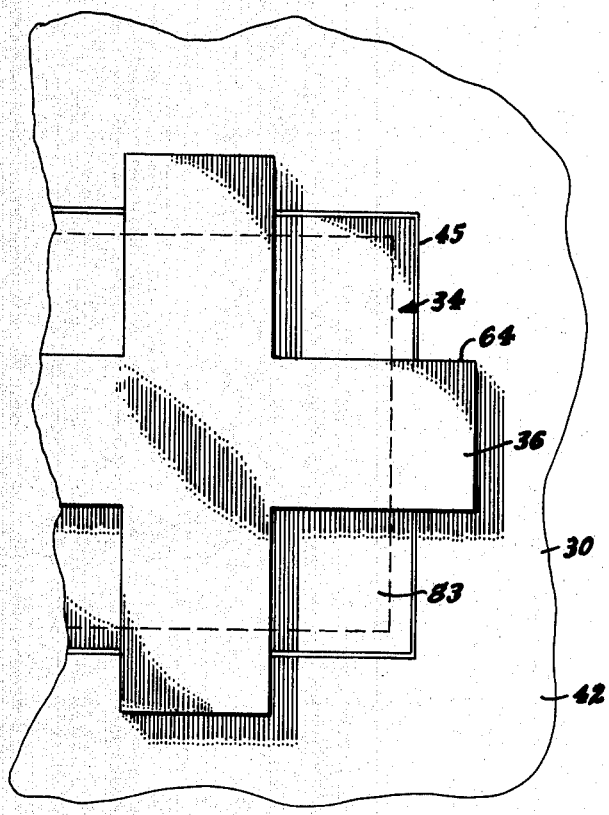
FIG. 20 is a wall-interior view like FIG. 17 but illustrating a fourth embodiment.

For good support, the inner body member 36 is preferably in the form of a cross (as shown in FIGS. 13, 17, and 20), and its discontinuities or cutouts 64 permit easy grasp of it by the installer even when reaching through the panel hole 32,45.

The embodiments of FIGS. 17–19 and 20–21 illustrate the concept of the first body member 34 being provided to be of a certain thickness such that, when the second body member 36 is adhesively retained (60) against or onto the rear surface 42 of the panel 30 and the first body member 34 is operatively seating against the second body member 36, the exterior face 66 of the first body member 34 is itself operatively flush with the exterior surface 46 of the panel 30 adjacent the panel hole 32,45 therein. This provides that the surface 66 of repair body 34 itself provides a portion of the finished repair-surface.

Figure 18:
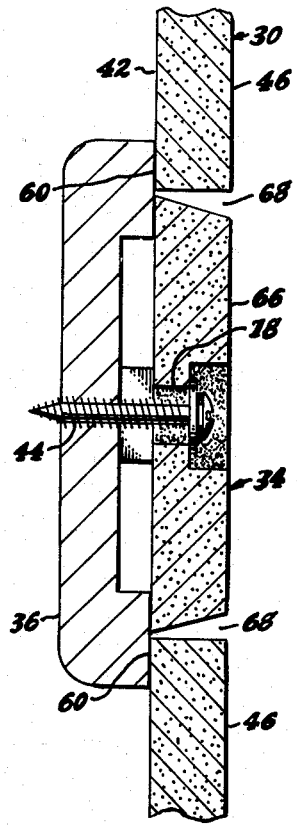
FIG. 18 is a vertical cross-sectional view through the panel in the side of the hole, similar to FIG. 11, but showing the third embodiment.
Figure 21:
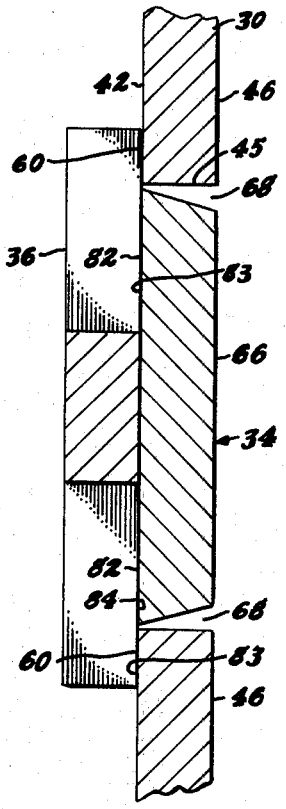
FIG. 21 is a vertical cross-sectional view like FIGS. 11 and 18, but of the fourth embodiment.

Particularly desirable, as shown in FIGS. 18, 21, and 26, the first body member 34 is shown provided as a piece of the same sheeting of which the panel 30 itself consists; and the portion of the second body member 36, against which the first body member 34 seats in establishing the position of the first body member 34, is provided to be operatively flush with the interior surface 42 of the panel 30 adjacent to the hole 32,45 therein. This assures desired operative flushness of the outer body member surface 66 with the outer panel surface 46.

FIGS. 18 and 21 illustrate the periphery of the first body member 34 being formed to be of a size and shape such that, in relation to the periphery of the panel hole 32,45 itself, there is a peripherally-extending void strip 68 accommodative of sufficient volume or bulk of patching mastic 38 to be endurable.

Figure 19:
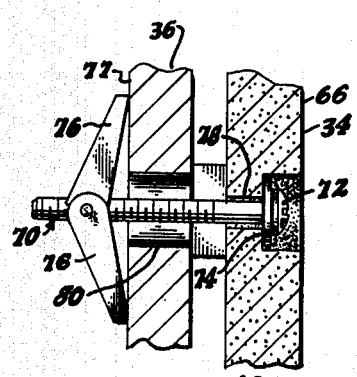
FIG. 19 is a detail view of the central portion of FIG. 18, but illustrating a toggle bolt type of connection.

The embodiment of FIG. 19 illustrates the concept of the second holding means 44 to be a toggle bolt 70, the head 72 of which operatively faces interiorly and operatively seats against an exteriorly-facing surface 74 of the first body member 34, and the wings 76 thereof when in assembled position face exteriorly and operatively seat against an interiorly-facing rear surface 77 of the second body member 36.

Enlarged diameters of openings 78 and 80, of the body members 34 and 36, respectively, give advantageous shiftability of components relative to one another, minimizing problems of fit, tolerance, and precision of alignment. Or, a conventional screw 44 is shown in FIG. 18.

The embodiment of FIGS. 20 and 21 illustrates further utilization of adhesive fastening means. That is, not only is the second body member 36 affixed to the rear 42 of the panel 30 by adhesive means 60, but the first holding means is itself provided to be an adhesive means 82 which operatively co-acts between rear portions 83 of the first body member 34 and exteriorly-facing portions 84 of the second body member 36 inwardly of the outline of the hole 32,45 in the panel 30.

The embodiment of FIGS. 22–26 provides a form in which the two body members 34 and 36 may be preglued together, as by glue at surface 85, or not preglued. In either form, this embodiment provides special advantage if adhesive means 60 are used which are of a type which have a drying or curative time. As there shown, there is provided a third body member 86 and also connector means 88 operatively interconnecting the second 36 and the third 86 body members, the third body member 86 being positioned exteriorly of the panel 30 so as to be able to bear inwardly against the panel 30 outwardly of hole 32,45 and exteriorly of the panel 30, thus supporting the second body member 36 against the panel 30 throughout the said drying or curative time. Since that is only a temporary period, the interconnecting means 88 is of a type easily released for freeing the third body member 86 from its position bearing against the exterior surface 46 of the panel 30 when the drying or curative time has passed; and the member 86 may then be removed and discarded.

More particularly as to the third body member 86, it is shown as provided to be of operatively long and of discontinuous or slender form so that during a first installation step it may be passed both inwardly and outwardly of the hole 32,45, that is, so that the third body member 86 may be passed initially inwardly through the panel hole 32,45 from exteriorly of the panel 30 to a position interiorly of the panel 30, and also that during a second or subsequent installation step the third body member 86 may be passed outwardly through the panel hole 32,45 from interiorly of the panel to a position exteriorly of the panel 30.

This latter or outward movement is as the assembly of the three body members (36,34, and 86) is moved in an outward direction to bring the second body member 36 into operative engagement with the rear wall 42 of the panel 30 for the drying or curing of the adhesive means 60; but the third panel member 86 is long enough to straddle across the panel hole 32,45 when then rotated (FIG. 25, in comparison to FIG. 24) to provide that outer portions 90 of the third body member 86 provide temporary support of the second body member 36, during the drying or curative time of the adhesive 60, by operatively bearing inwardly against the panel 30 adjacent the hole 32,45.

It is thus seen that a repair patching kit for panels, according to these inventive concepts, provides a desired and advantageous invention, achieving economically yet conveniently a high-quality and fine-appearing repair, even though access to the panel is from only the finish side, permitting such repairs by a novice as a do-it-yourself project, substantially as easy as by an experienced handyman or repairman. Only a minimum of mechanical skill or understanding is required.

Accordingly, it will thus be seen from the foregoing description of the invention according to these illustrative embodiments, considered with the accompanying drawings, that the present invention provides new and useful concepts of a panel repair kit such as for drywall panels, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. A repair patching kit for applying a repair patch to a panel having a hole therein and having restricted access to the interior face to the panel, comprising:

a first body member;

a second body member;

a third body member;

adhesive holding means for operatively holding the second body member operatively against the interior face of the panel in the region of but straddling the hole in the panel, the adhesive holding being adhesive means having a drying or curative time;

and second holding means for operatively holding the first body member in the region of the hole in the panel and connected to the second body member but exteriorly of the second body member and with the exterior face of the first body member operatively flush with or inwardly of the exterior face of the panel;

the said second body member being of a form, in relation to the size of the panel hole, which provides that in an installation step the second member may be passed through the panel hole from exteriorly of the panel to a position interiorly of the panel, but nevertheless is long enough, when moved to a position in which it straddles the panel hole, to provide its function of providing retaining support for the first body member by retaining engagement with the interior face of the panel adjacent the hole;

and means operatively interconnecting the second and the third body members, the third body member being positioned exteriorly of the panel so as to be able to operatively bear inwardly, against the panel outwardly of hole and exteriorly of the panel thus supporting the second body member against the panel throughout the said drying or curative time, the last-mentioned interconnecting means being of easily released nature or form for freeing the third body member from its position bearing against the exterior surface of the panel when the said drying or curative time has passed;

in which the third body member is long enough to operatively straddle the panel hole to present portions of the third body member to provide its temporary support of the second body member, during the drying or curative time of the adhesive means, by operatively bearing inwardly against the panel adjacent the hole therein;

and in the thus-assembled position, the first body member provides a portion of the exteriorly-facing panel repair or a body member to which patching mastic may adhere to in a spread thereof from the exterior surface of the panel outwardly adjacent the hole therein.

2. The invention as set forth in claim 1 in a combination in which the means operatively interconnecting the second and third body member is a bolt means, the third body member being provided with an opening means through which said bolt means extends.

3. The invention as set forth in either of claims 1 or 2, in a combination in which the third body member is provided to be of operatively long and of discontinuous or slender form so that during a first installation step it may be passed inwardly through the panel hole from exteriorly of the panel to a position interiorly of the panel, and that during a second installation step it may be passed outwardly through the panel hole from interiorly of the panel to a position exteriorly of the panel as the assembly of the three body members is moved in an outward direction to bring the second body member into operative engagement with the panel for the drying or curing of the adhesive means.

* * * * *

UNITED STATES PATENT AND TRADEMARK OFFICE

CERTIFICATE OF CORRECTION

PATENT NO. : 4,370,842

DATED : February 1, 1983

INVENTOR(S) : Verble C. Martin; Robert J. Forestal

It is certified that error appears in the above—identified patent and that said Letters Patent is hereby corrected as shown below:

Col. 6, line 67: after "holding" insert the word: -- means --.

Col. 6, line 67: Delete the word "being".

Col. 6, line 68: Delete the words "adhesive means".

Signed and Sealed this

*Nineteenth* Day of *April 1983*

[SEAL]

*Attest:*

GERALD J. MOSSINGHOFF

*Attesting Officer*

*Commissioner of Patents and Trademarks*